US006739480B1

(12) United States Patent
Albrecht et al.

(10) Patent No.: US 6,739,480 B1
(45) Date of Patent: May 25, 2004

(54) DOSING DEVICE FOR LIQUIDS

(75) Inventors: Eberhard Albrecht, Wertheim (DE); Thomas Beeh, Wurzburg (DE); Peter Mahler, Kreuzwertheim (DE)

(73) Assignee: Brand GmbH + CO KG, Wertheim (DE)

( * ) Notice: Subject to any disclaimer, the term of this patent is extended or adjusted under 35 U.S.C. 154(b) by 159 days.

(21) Appl. No.: 10/149,254

(22) PCT Filed: Nov. 25, 2000

(86) PCT No.: PCT/EP00/11757

§ 371 (c)(1),
(2), (4) Date: Jun. 10, 2002

(87) PCT Pub. No.: WO01/41908

PCT Pub. Date: Jun. 14, 2001

(30) Foreign Application Priority Data

Dec. 9, 1999 (DE) ..... 199 59 524

(51) Int. Cl.[7] ..... B67D 5/52

(52) U.S. Cl. ..... 222/137; 222/145.6; 222/145.7; 222/148; 222/309

(58) Field of Search ..... 222/63, 136, 137, 222/145.5, 145.6, 145.7, 148, 149, 150, 309, 386

(56) References Cited

U.S. PATENT DOCUMENTS 1,360,298 A * 11/1920 William et al. ..... 239/304
3,207,376 A 9/1965 Molitor
5,219,097 A * 6/1993 Huber et al. ..... 222/145.2
5,542,574 A * 8/1996 Stern ..... 222/137
5,573,729 A * 11/1996 Belgardt et al. ..... 422/100
5,803,312 A 9/1998 Credle, Jr. et al.
5,899,362 A * 5/1999 Moran ..... 222/136

FOREIGN PATENT DOCUMENTS

| | | |
|---|---|---|
| DE | 197 02 773 A1 | 7/1998 |
| DE | 197 02 778 A1 | 7/1998 |
| EP | 0 197 655 A2 | 10/1986 |
| EP | 0 448 394 A2 | 9/1991 |
| EP | 0 855 580 A2 | 7/1998 |

* cited by examiner

*Primary Examiner*—Joseph A. Kaufman
(74) *Attorney, Agent, or Firm*—Nixon Peabody LLP; David S. Safran

(57) ABSTRACT

A dosing device with which several, preferably two, liquids can be measured and dispensed in precise quantities. In this dosing device, two bottle-top dispensers with integrated suction valves, discharge valves and a bottle-top mechanism are attached in a housing. A liquid-reservoir bottle can be affixed to the bottle-top mechanism of each bottle-top dispenser. In particular, affixing of the respectively associated reservoir bottles is ensured without confusion. Activation of the pistons of the bottle-top dispensers takes place with working strokes which differ depending on the spacing. In addition, the housing comprises a blow-out device by means of which, after each dispensing procedure, the discharge device for the liquids can be blown out and cleared of any liquid residues.

26 Claims, 6 Drawing Sheets

DOSING DEVICE FOR LIQUIDS

FIELD OF THE INVENTION

The present invention relates to a dosing device for liquids with which several, preferably two, liquids can be brought together in precisely measured quantities and mixed together.

BACKGROUND OF THE INVENTION

The known dosing device for dispensing several liquids, which forms the basis of this invention (Published European Application 0 448 394), comprises at least two cylinder-piston arrangements connected by one suction valve and one suction line each to an external liquid-reservoir and to a discharge device with a mixing chamber and discharge aperture via a discharge line with discharge valve. All the components of the dosing device are interconnected and thus, if the dosing device is accommodated in a housing, said components are arranged in said housing, while the liquids to be mixed together, such as a drink concentrate and water, are fed via admission lines from liquid-reservoirs outside the housing. In this known dosing device, the diameters of the cylinder-piston arrangements vary widely so that with one and the same piston stroke, different quantities of liquids can be dispensed, for example at a ratio of 1:3. Furthermore it is also possible to modify the lever mechanism driven by a single mutual drive element, namely a hand lever of a drive device, such that the pistons are moved with different lever arms, in which case different piston strokes are achieved with one and the same drive movement of the drive element. In this way too, the dispensed ratio of the liquids can be altered.

The above mentioned dosing device for liquids, known in the art, by means of which device several liquids can be brought together in precisely measured quantities and mixed, can still be improved from the point of view of handling. Furthermore, in particular for specific medical, pharmaceutical and chemical applications it would be more useful if this dosing device were a device, which, on the whole, could be handled as a closed unit. Moreover, but related to the above, it would be desirable to shift the dispensed ratio of the different liquids to significantly higher levels and to make said ratio flexible and/or adjustable. Finally, again of particular significance in the fields of medical, pharmaceutical and chemical applications, it would be desirable in such a dosing device, if the discharge device could be cleared of liquid residues in a targeted way.

SUMMARY OF THE INVENTION

According to the present invention, the cylinder-piston arrangements of the dosing device are not connected to the respective liquid-reservoirs via admission lines, but instead, these cylinder-piston arrangements are designed more or less as commercially available bottle-top dispensers (see e.g. published German applications 197 02 773 and DE 197 02 778). Integrated in the bottle-top mechanism, which usually is a screw-on mechanism, of a bottle-top dispenser, and also integrated in a dispensing arm jutting out from said bottle-top dispenser, are the suction valves and the discharge valves as well as the suction lines and the discharge lines. This is a compact design which has been well proven in practical applications. Each of the bottle-top dispensers is firmly attached in the housing. Thus, according to the invention, the bottle-top dispensers are used atypically, namely firmly attached in the housing, while the liquid-reservoir bottles are attached to the fixed bottle-top dispensers by means of the bottle-top mechanism, in particular screwed on. In this way there is no need for external admission lines and external liquid-reservoirs. This is a construction that results in an overall compact design of the dispensing device, where applicable in a closed housing. This is very useful, in particular for the above-mentioned applications in the medical, pharmaceutical and chemical sectors.

The possibility of designing a dosing device with which a large dispensing ratio is to be achieved exists in making the effective lever arms for activating the pistons of the cylinder-piston arrangements very differently. One and the same drive movement of the drive device then leads to very different working strokes of the pistons. If the cylinder-piston arrangements are arranged side-by-side in relation to the principal plane of the housing of the dosing device, then the desired significantly different lever transmission can be achieved by way of an operating lever located on one side, and by the cylinder-piston arrangements being sufficiently spaced apart from each other. While the housing is wide in this arrangement, it is not excessively deep.

The blow-out device makes it possible to clear the liquids to be dispensed from the discharge device, either automatically after each dispensing procedure or optionally only as deemed necessary. In this way it is possible to avoid undesirable chemical processes in the case of liquid components remaining in the discharge device for an extended period of time.

Of particular significance is the use of a dosing device according to the invention for mutual dispensing of different components of a medically effective disinfectant, in particular a temporarily stable peroxide-alcohol mixture.

Below, the invention is explained in more detail by means of a drawing which shows only examples of embodiments as follows:

DETAILED DESCRIPTION OF THE INVENTION

Figure 1:
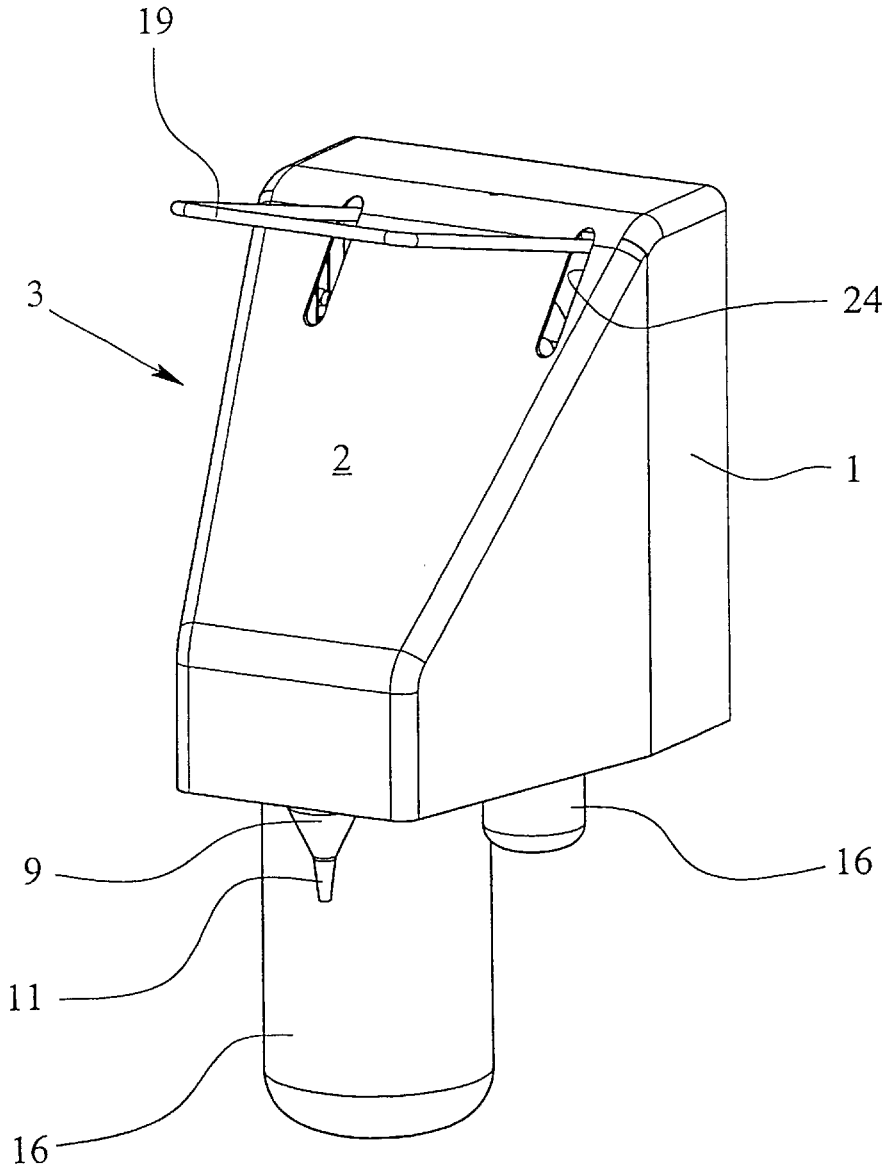
FIG. 1 is a dosing device with a closed housing, in a perspective view.

The dosing device shown in perspective view in FIG. 1 is destined for liquids, in particular for various liquid components of disinfectants and more particularly for common dispensing of different components of a medically effective disinfectant, in particular a peroxide-alcohol mixture.

The dosing device shown in FIG. 1 is a device suitable for installation on a wall, with a supporting frame 1 to be fixed to the wall and a hood 2 placed on the supporting frame 1, said hood covering the entire dosing device. Together, the supporting frame 1 and the hood 2 form a housing 3.

Figure 2:
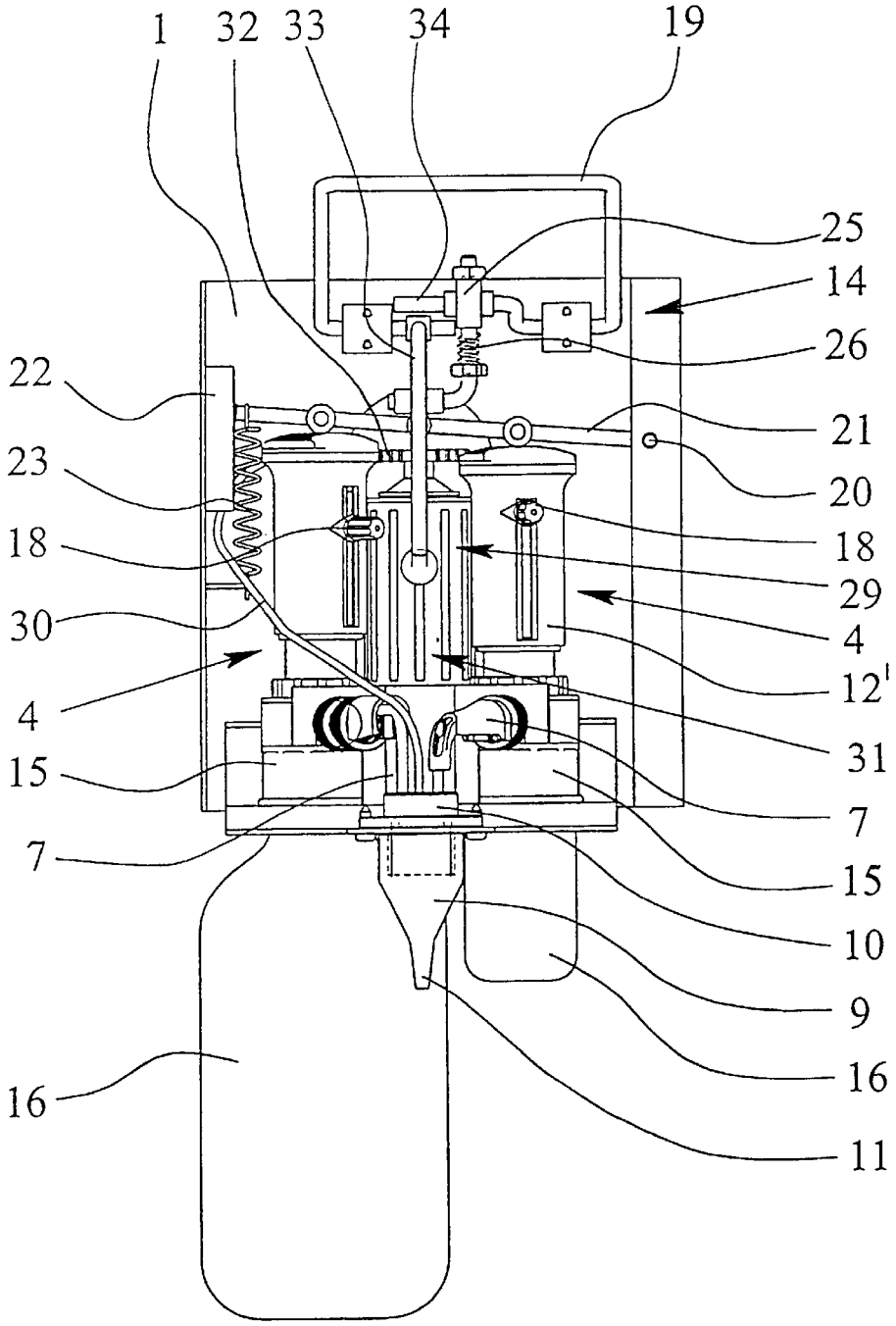
FIG. 2 is the dosing device shown in FIG. 1, with the hood removed.

FIGS. 1 and 2 show in context that several (two in the embodiment shown) cylinder-piston arrangements 4 are arranged in the housing 3 at the supporting frame 1, each of which is able to dispense a liquid component that has been exactly measured.

Figure 6:
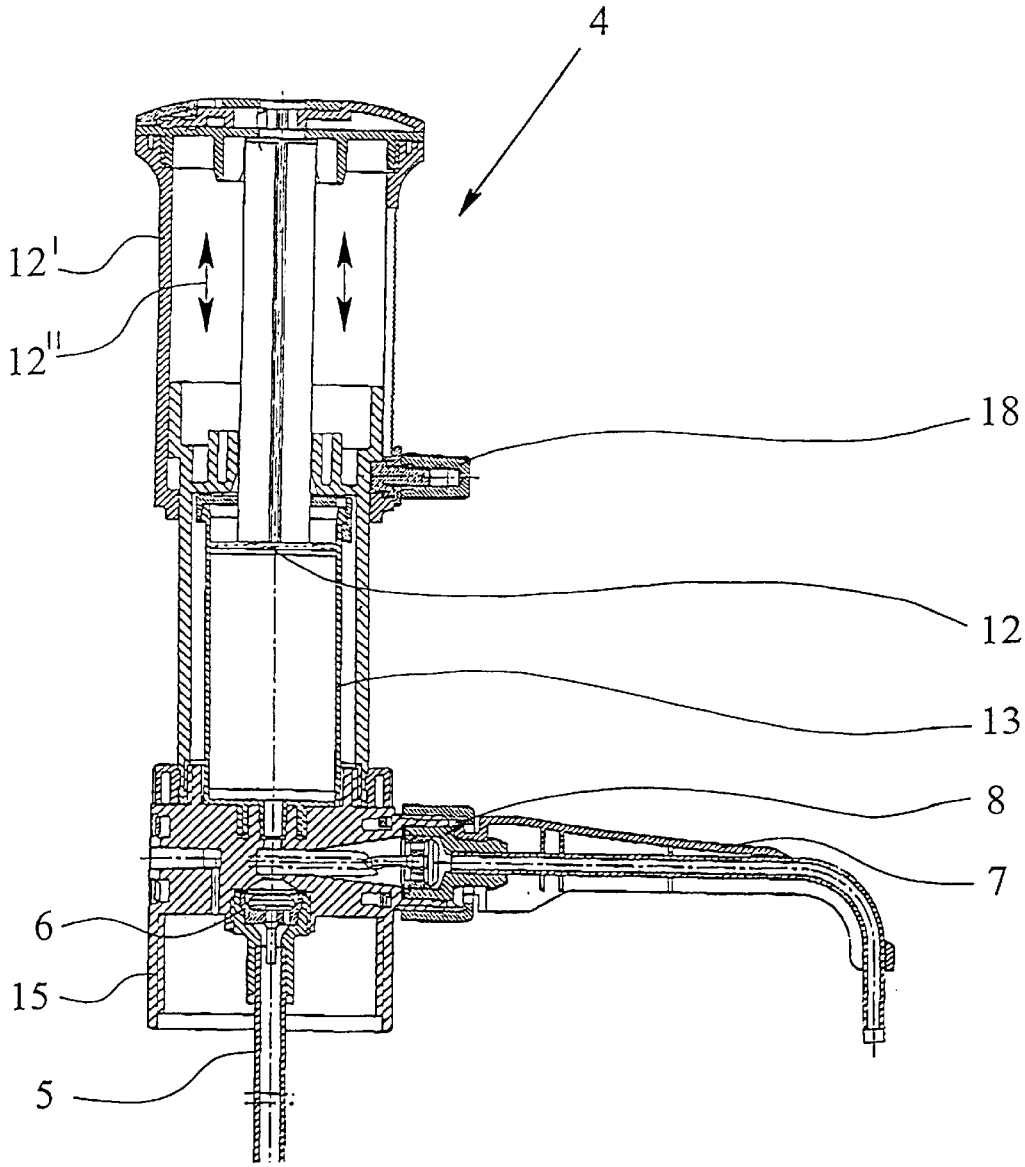
FIG. 6 is a vertical section view of a bottle-top dispenser of the dosing device from FIG. 2.

FIG. 6 which is a sectional view of a typical cylinder-piston arrangement 4 shows that a suction line 5 with a suction valve 6 and a discharge line 7 with a discharge valve 8 are associated with each cylinder-piston arrangement 4. Arranged near the bottom of the housing 3 and protruding from said housing 3 is a discharge device 9 with a mixing chamber 10, which can be provided but need not be provided, in which the discharge lines 7 merge to form a discharge aperture 11. In the embodiment shown, the discharge aperture 11 is shaped as a hollow needle so that the liquid mixture can be dispensed in a targeted manner without any splashes.

In particular if the described dosing device is used for common dispensing of different components of a medically active disinfectant into the hands of a user, targeted dispensing without any splashes is very useful.

In order to dispense liquid, the pistons 12 of the cylinder-piston arrangements 4, which pistons 12 move in the cylinders 13, must be driven in a common dispensing movement. This takes place with a drive device 14 which will be explained in detail below. FIG. 6 shows a piston 12 of a cylinder-piston arrangement 4 as is known per se for bottle-top dispensers (See e.g. published German applications 197 02 773 and DE 197 02 778) and an exterior shell 12' connected to the piston. The exterior shell 12' moves together with the piston 12. In practical application, a readjusting spring 12" is located in the interior space above the cylinder 13, said interior space being formed by the exterior shell 12', with said readjusting spring 12" having been installed so that its spring force acts upwards, shown in the diagram by the double arrow indicating the spring force. This readjusting spring 12" ensures that the piston 12 with the exterior shell 12' moves upwards with spring force to an end stop whose height has been specified by a stroke adjusting device 18. Downward movement of the piston 12 with the exterior shell 12' takes place against the spring force.

In FIGS. 2 to 5, the piston 12 of the respective cylinder-piston arrangement 4 is not visible; only the exterior shell 12' is visible which, in a sense, represents the piston 12.

FIGS. 2 and 6 in context now show that the cylinder-piston arrangements 4 in these cases are bottle-top dispensers of typical design (See e.g. published German applications 197 02 773 and DE 197 02 778). Integrated into each bottle-top dispenser 4 is the suction valve 6 and the discharge valve 8 as well as the suction line 5 and the discharge line 7, with each of said bottle-top dispensers 4 comprising a bottle-top mechanism 15. In most cases, such a bottle-top mechanism 15 is a clip-on cap or a screw-on cap which corresponds to a particular design of the neck of a liquid-reservoir bottle 16. The suction line 5, which extends downwards from the bottle-top mechanism 15 into the reservoir bottle 16 as a hose or tube can be identified as well as the discharge line 7 which, typically in the shape of a bent and protruding metering arm, leads to the discharge device 9.

It is significant for the invention that the bottle-top dispensers 4 with bottle-top mechanisms 15 or respective components are fixed to the housing 3, in the embodiment shown to a supporting plate 17 of the supporting frame 1, so that on each fixed bottle-top mechanism 15 of each bottle-top dispenser 4, a liquid-reservoir bottle 16 can be exchangeably affixed. In FIGS. 1 and 2, different sizes of reservoir bottles are shown for the two liquid components to be dispensed.

A variation in which the liquid-reservoir bottles 16 are arranged in the housing 3 and in which the housing 3 can be opened for exchanging the liquid-reservoir bottles 16 is not shown in the drawing. However, an embodiment is shown which is characterized in that the bottle-top mechanism 15 is arranged at the edge, in particular at the bottom of the housing 3 and in that the liquid-reservoir bottle 16 can be affixed to it from the outside. FIGS. 1 and 2 show very clearly in context that in the embodiment shown, in which the dispensed and combined quantities of liquid are very different, the sizes of the reservoir bottles 16 for the two liquids to be mixed together are very different. The embodiment shown may for example contain a temporarily stable peroxide-alcohol mixture with a typical mixing ratio of peroxide to alcohol of 1:40. However, quite different and far higher mixing ratios can be achieved with the dosing device according to the invention because one can operate with extremely differently designed cylinder-piston arrangements 4. Incidentally, it is recommended for provisions to be made to the effect that the individual cylinder-piston arrangements 4, which are designed as bottle-top dispensers, and/or individual parts thereof can be exchanged for components of different dimensions and consequently different dispensing volumes. In this way, the same dosing device can be converted to quite different mixing ratios, with much greater difference than can be obtained with conventional adjustment options such as stroke adjustment and adjustment in lever ratios.

To this extent, provisions can also be made so that practically only the outer shape of the bottle-top dispenser remains, while the internal components are completely exchanged. For example, it is then also possible to install a micro pipette unit in the interior of the bottle-top dispenser, said micro pipette unit being of course known per se.

To preclude any confusion of the bottle-top dispensers 4, provisions can also be made for the bottle-top mechanisms 15 of the different bottle-top dispensers 4 to be of different design so that attachment of the respective reservoir bottle 16 is ensured without any confusion. The way to achieve this in individual cases, for example by means of different diameters of the interior threads of the bottle-top mechanisms 15, forms part of the repertoire of the average person skilled in the art and does not need to be explained in further detail in this document.

Just as it is possible to ensure that the respectively associated reservoir bottle 16 can be affixed without confusion, when designing bottle-top dispensers 4 with exchangeable parts, the design of such exchangeable parts can be made so as to preclude confusion. This ensures that it is not possible to erroneously dispense completely different measured volumes as a result of different dimensioning of the "inside components" of the bottle-top dispenser 4. This can for example be achieved in that the coupling mechanism for the head of the piston 12 in the exterior shell 12' is designed so as to preclude any confusion. If a micro pipette unit is used, a construction which precludes any confusion can be achieved in that the required adaptor for installing the micro pipette unit in the bottle-top dispenser 4 is designed accordingly so as to preclude any confusion.

Figure 4:
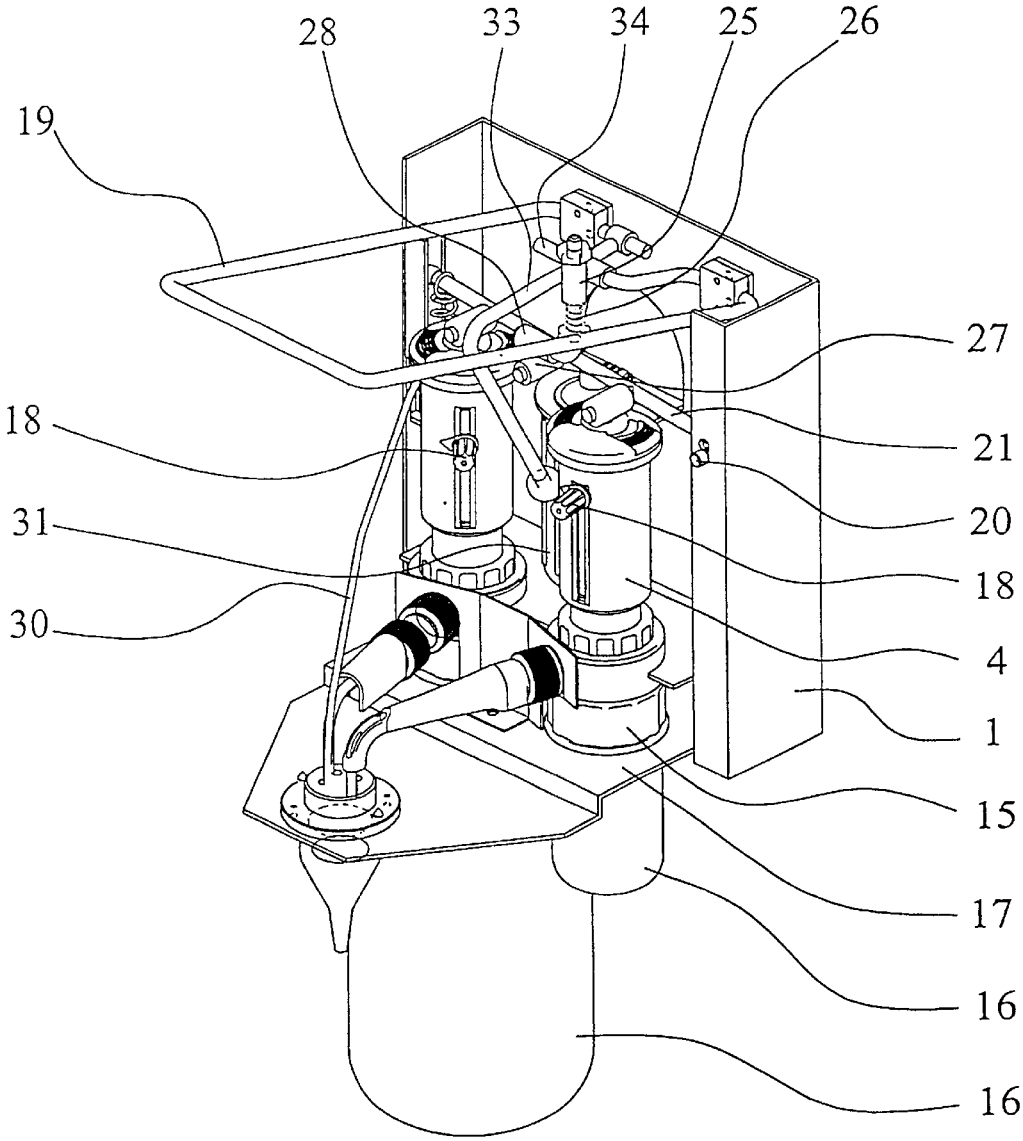
FIG. 4 is the dosing device shown in FIG. 2, as seen at an oblique angle from the top.

FIGS. 2 and 4 clearly show that the working strokes of the pistons 12 of the cylinder-piston arrangements 4 can be individually set by means of individual stroke adjusting devices 18. In this way too, the dispensing ratio can later be adjusted, at least to some extent. The diameter of the cylinder 13 of the cylinder-piston arrangement 4 is, of course, the other component that can be influenced for changing the mixing ratio.

The shown and preferred embodiment shows a mechanical drive device 14 which comprises a lever mechanism with which, by way of a unified drive movement of a drive element 19, a different working stroke of the pistons 12 is achieved. The second embodiment, shown in FIG. 5, achieves this function in that for each piston, the lever mechanism comprises a bearing axle 20 located on one side for each operating lever 21 jutting out from it; in that the cylinder-piston arrangements 4 are arranged so as to be spaced apart differently from the bearing axle 20; and in that in this way, common activation of the operating levers 21 causes a working stroke of the pistons 12 which is different, depending on the spacing.

In this embodiment, spacing between the cylinder-piston arrangements 4 from the bearing axle 20 is limited in that the housing 3 of the dosing device cannot become too deep, at least for wall mounting as intended in this embodiment.

Figure 3:
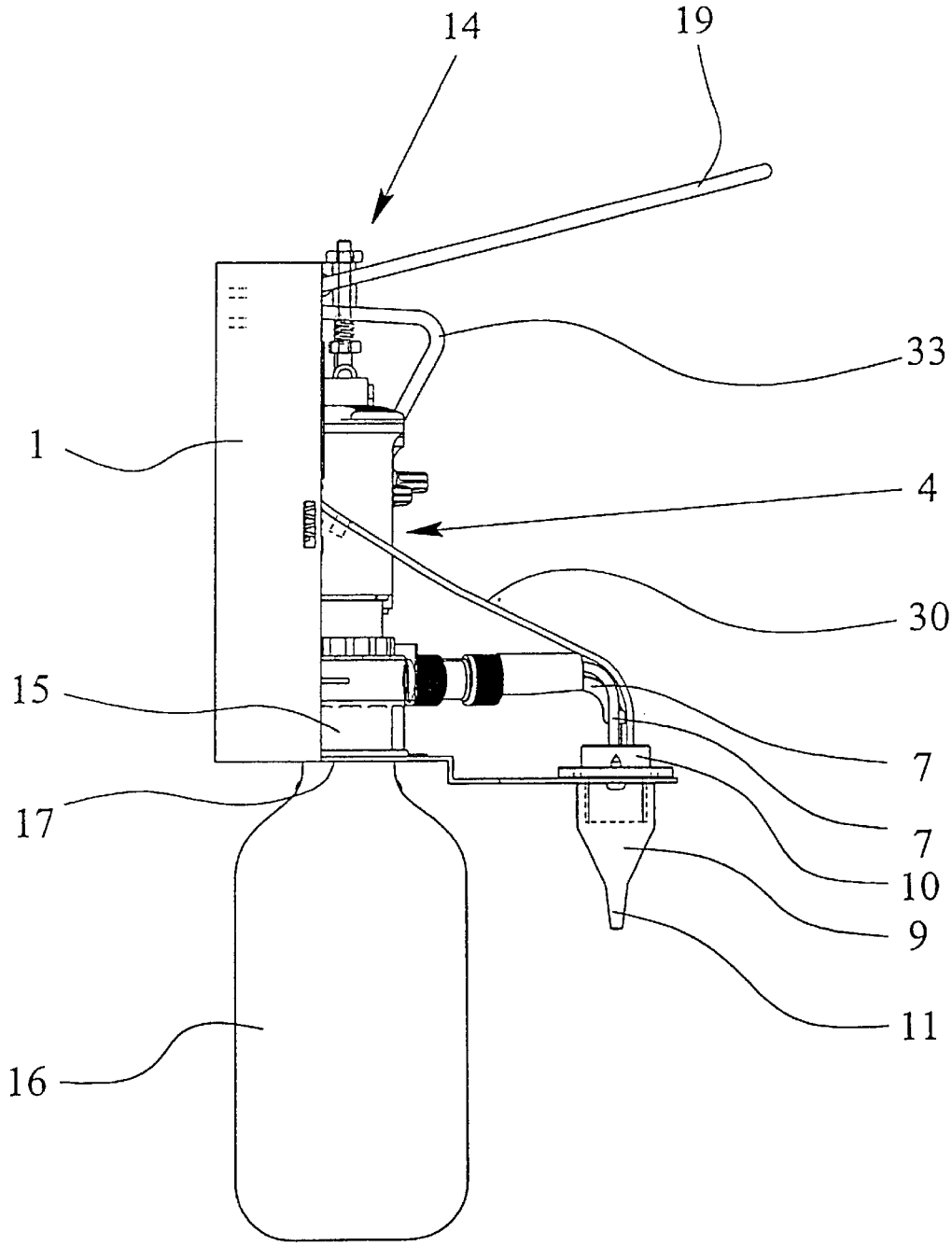
FIG. 3 is the dosing device shown in FIG. 2, as seen from the left in FIG. 2.

Thus, the embodiment shown in FIGS. 2 to 4 is characterized by a differently arranged lever mechanism. With this mechanism, the lever mechanism comprises a one-sided bearing axle 20 for a single operating lever 21 for the pistons 12 of both cylinder-piston arrangements 4, said single operating lever 21 jutting out and being arranged transversely in the housing 3. By arranging the cylinder-piston arrangements 4 side-by-side in the housing 3, different spacing between the individual cylinders and pistons and the bearing axle 20 is achieved automatically. Thereby, a different working stroke of the pistons 12 is achieved automatically. Since the spacing of the cylinder-piston arrangements 4 in the width of the housing 3 can become significantly larger than in the depth of the housing 3, this provides a possibility of achieving a significantly higher dispensing ratio by way of a significantly increased difference in the piston stroke.

FIG. 2 shows the bearing axle 20 on the right hand side, and opposite it, on the left hand side of the supporting frame 1, a guide 22 for the operating lever 21. Said operating lever 21 is guided on the side by the guide 22 and, incidentally, held by a guide spring 23, so as to loosely rest on the piston heads.

The shown and preferred embodiment further shows that the drive element 19 of the drive device 14 is a hand lever, preferably U-shaped, which is coupled in the housing 3 and protrudes from said housing 3. In FIG. 1, the hand lever, which forms the drive element 19, comes out of the hood 2 of the hosing 3 through two slots 24. As is common in medical applications, this hand lever can be pressed down with the elbow while one hand is placed below the discharge aperture 11 of the discharge device 9.

FIG. 2 shows that the drive element 19 is spring-loaded towards its home position by means of a readjusting spring 26 which is shown on a sleeve 25. Incidentally, it is provided that the operating lever 21 only rests against the heads of the pistons 12 of the cylinder-piston arrangements 4, with said pistons 12 being spring-loaded (by way of internal readjusting springs 12", FIG. 6) in the direction of restoration. The readjusting spring 26 of the drive element 19 is used to restore the home position.

FIG. 4 shows that force transmission from the drive element 19 formed by the U-shaped hand lever to the operating lever 21 takes place via a deflection roller 27 and an operating roller 28 aligned transversely in relation to said deflection roller 27, so that the mutual relative movements of the individual components can be absorbed without any problem.

A drive device 14 which, from the point of view of drive technology, is more elaborate and more expensive, and which is also known from the state of the art comprises one or two electrical drive motors (See e.g. published European application 0 197 655). This is a further passable alternative which makes variable dispensing of quantities of liquid even more convenient but also significantly more expensive.

As has already been pointed out above, the working stroke of the pistons 12 of the cylinder-piston arrangements 4 can be adjustable by way of the already mentioned stroke adjusting device 18.

Figure 5:
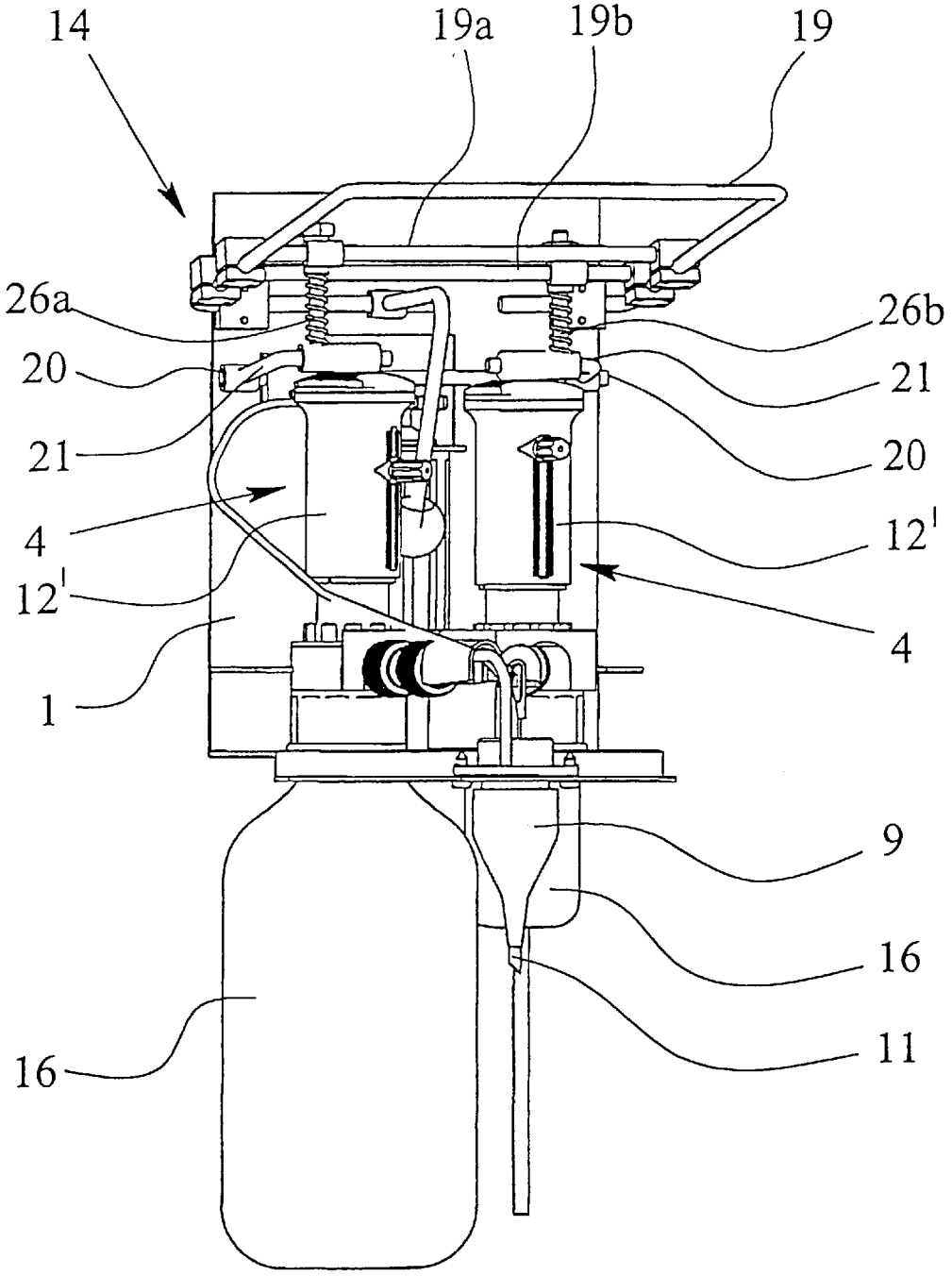
FIG. 5 is a second embodiment of a dosing device with a different lever mechanism.

To this extent, FIG. 5 shows a particularly interesting embodiment of a drive device 14 of a dosing device according to the invention, in that for each cylinder-piston arrangement 4, the drive element 19 comprises a force introduction element 19*a*; 19*b* of its own, wherein said force introduction element 19*a*; 19*b* acts in unison with the respective separate operating lever 21. Each force introduction element 19*a*; 19*b* is coupled to the associated operating lever 21 of the respective cylinder-piston arrangements 4 by way of a dead centre connection. This dead centre connection can preferably be adjusted and; at any rate, in the embodiment shown it comprises a readjusting spring 26*a*; 26*b*. In the embodiment shown, the force introduction elements 19*a*; 19*b* are transverse bars of the U-shaped hand lever which forms the drive element 19. This decoupling of the individual cylinder-piston arrangements 4 from the drive device 14 makes it possible to adjust the time sequence of activating the cylinder-piston arrangements 4 and the stroke path of the pistons 12/exterior shells 12'. When applying an even movement to the drive element 19 having a corresponding design to the couplings mentioned above, delayed activation of the cylinder-piston arrangements 4 as required in practical application can be achieved. To achieve this, the spring force of the readjusting springs 12" of the cylinder-piston arrangements 4 must of course be carefully matched to the spring force of the readjusting springs 26*a*; 26*b*.

According to a preferred embodiment of the invention, the dispensing ratio of the different types of liquids typically ranges from 1:20 to 1:80, preferably approx. 1:40. However, it is possible to achieve significantly higher dispensing ratios, for example increased by one to two powers of ten. It is particularly preferred that a total quantity of liquid of 1 to 5 ml, preferably of approx. 3 ml, is dispensed during each stroke.

FIGS. 2 to 4 show a further particular characteristic of the dosing device according to the invention. This preferred embodiment provides for a blow-out device 29 to be arranged in the housing 3 and to be connected to the discharge device 9 via a blow-out line 30. The blow-out device 29 can either be activated automatically after each dispensing procedure or optionally it is activated as the operator deems necessary.

The embodiment shown shows a pressure container 31 made from a compressible, preferably rubber-like material, said pressure container 31 being able to be compressed so as to generate a blast of compressed air. At the head of the pressure container 31 there is a connection 32 for the blow-out line 30. In FIG. 2, the blow-out line 30 starts on the left at the connection 32 where there is a built-in pressure check valve. On the right a stub of the connection 32 protruded, with a suction check valve being built into said stub. Thereby, an unequivocal direction of flow is dictated for the blow-out air.

Fundamentally, the pressure container 31 of the blow-out device 29 could be a store of compressed air, for example a compressed-air cartridge. In this case, only one valve would have to be opened for a short time to generate a blast of compressed air. However, this is disadvantageous in that such a pressure container would then have to be frequently replaced or re-filled. The shown and preferred embodiment shows that the elastically compressible pressure container 31 can be compressed by the drive element 19 on completion of the liquid-dispensing stroke with a subsequent blow-out stroke. Thus, the pressure container 31 acts as a kind of air pump.

The shown and preferred embodiment is further characterized in that by means of the readjusting spring 26 arranged in-line, whose function has already been explained above, the drive element 19 acts on the operating lever 21 of the cylinder-piston arrangements 4, 50 that when the operating lever 21 is already at a standstill, i.e. after completion of the dispensing stroke, the drive element 19 can continue its drive movement along a defined path, thus being able to carry out the blow-out stroke. In order to make this possible, in the embodiment shown, the blow-out device 29 comprises a pressure lever 33 which, in turn, is depressed during the blow-out stroke by a recess 34 in the drive element 19, said pressure lever 33 with its thick end depressing the elastic pressure container 31 in the manner of an air pump. Thereby, during the last section of travel, the blow-out function is carried out very simply and automatically.

As far as the spring force ratios are concerned, the same holds true as has already been explained above, that the readjusting spring 26 is "harder" than the co-acting readjusting springs 12" in the cylinder-piston arrangements 4. In this way, the previously explained time sequence is achieved.

A preferred embodiment which is not recognizable as such in the drawing, is furthermore characterized, in view of the blow-out device 29, in that the blow-out line 30 comprises a check valve at the opening/orifice into the discharge device 9. This check valve can simultaneously serve as the pressure valve which is otherwise seated at the connection 32 on the pressure container 31, as explained above. This valve simultaneously ensures that no undesirable liquid flows back from the mixing chamber 10 to the blow-out line 30.

Analogously, it would, of course, also be possible for the openings of the discharge lines 7 into the discharge device 9 to comprise check valves.

In respect to the mixing chamber 10, prior art provides many suggestions as to its design. The mixing chamber 10 must be designed and dimensioned so that it is suitable for the liquids to be mixed therein. To this effect, there are a large number of proposals in the state of the art, to which reference can be made. In particular, there is, of course, a difference if liquids are to be mixed which, due to their chemical consistency, easily mix by themselves or if liquids are processed which need to be mixed using mechanical aides.

The use of a dosing device of the type at issue is of particular significance for mutual dispensing of different components of a medically effective disinfectant, in particular a temporarily stable peroxide-alcohol mixture.

What is claimed is:

1. A dosing device for bringing together and mixing several liquids in precisely measured quantities, comprising:

a housing in which at least two cylinder-piston arrangements are disposed, each cylinder-piston arrangement having a suction line with a suction valve and a discharge line with a discharge valve;

a discharge device in which the discharge lines merge to form a discharge aperture;

a drive device for driving the pistons of the cylinder-piston arrangements in a mutual dispensing movement;

wherein said cylinder-piston arrangements are part of a bottle-top dispenser, each said cylinder-piston arrangement being firmly attached to the housing by way of a respective bottle-top mechanism; and wherein said bottle-top mechanism is adapted for exchangeable affixing of a liquid-reservoir bottle thereto.

2. A dosing device for liquids according to claim 1, wherein the discharge device includes a mixing chamber.

3. A dosing device for liquids according to claim 1, wherein liquid-reservoir bottles are arranged in the housing and the housing is openable for exchanging the liquid-reservoir bottles.

4. A dosing device according to claim 1, wherein each bottle-top mechanism is arranged at an edge of the housing and a respective liquid-reservoir bottle is affixable thereto from outside of the housing.

5. A dosing device according to claim 1, wherein the individual cylinder-piston arrangements are composed of individual parts which are exchangeable for similar parts of different dimensions and different dispensing volumes.

6. A dosing device according to claim 5, wherein individual exchangeable parts of the bottle-top dispensers are designed so as to avoid confusion of similar parts.

7. A dosing device according to claim 1, wherein the bottle-top mechanisms of the bottle-top dispensers are of different designs in order enable identification of which liquid-reservoir bottle should be attached to each of the bottle-top dispensers.

8. A dosing device according to claim 1, wherein the drive device comprises a lever mechanism including a drive element for a unified drive movement such that a different working stroke of the pistons the cylinder-piston units is achieved.

9. A dosing device according to claim 8, wherein for each cylinder piston arrangement, the lever mechanism comprises a bearing axle on one side of the housing attached to an operating lever extending therefrom, wherein the cylinder-piston arrangements are positioned such that common activation of the operating lever causes a working stroke of the pistons that differs depending on a spacing of the cylinder piston arrangements relative to the bearing axle.

10. A dosing device according to claim 9, wherein the operating lever rests against heads of the pistons of the cylinder-piston arrangement when in a non-dispensing position and said pistons are spring-loaded in a non-dispensing direction.

11. A dosing device according to claim 8, wherein the lever mechanism comprises a bearing axle on one side of the housing attached to a single operating lever extending transversely in the housing, said operating lever operating all the cylinder-piston arrangements, wherein the cylinder-piston arrangements are positioned such that activation of the operating lever causes a working stroke of the pistons that differs depending on a spacing of the cylinder piston arrangements relative to the bearing axle.

12. A dosing device according to claim 8, wherein the drive element of the drive device is a U-shaped hand lever which is coupled in the housing and protrudes from said housing.

13. A dosing device according to claim 8, wherein the drive element is spring-loaded towards a non-dispensing position.

14. A dosing device according to claim 1, wherein the drive device includes a drive element which comprises an electric drive motor which drives each cylinder-piston arrangement individually or drives all cylinder-piston arrangements at one time.

15. A dosing device according to claim 1, wherein a working stroke of the piston of the cylinder-piston arrangements is adjustable.

16. A dosing device according to claim 1, wherein, for each cylinder-piston arrangement, the drive element comprises a force introduction element which acts in unison with a respective separate operating lever and is coupled to an associated operating lever by a dead center connection which includes a readjusting spring.

17. A dosing device according to claim 1, wherein the drive element dispenses liquids from the liquid-reservoir bottles in a ratio from 1:20 to 1:80.

18. A dosing device according to claim 1, wherein the drive element dispenses a total quantity of liquid of 1 to 5 ml during each dispensing procedure.

19. A dosing device according to claim 1, wherein a blow-out device is arranged in the housing and connected to the discharge device via a blow-out line such that the blow-out device is automatically activatable after each dispensing procedure.

20. A dosing device according to claim 19, wherein the blow-out device comprises an elastically compressible pressure container which acts as an air pump and is adapted to be elastically compressed during each dispensing procedure so as to generate a blast of compressed air.

21. A dosing device according to claim 20, wherein the pressure container is compressible by the drive element with a subsequent blowout procedure upon completion of liquid dispensing.

22. A dosing device according to claim 21, wherein the drive element acts on the operating lever via an interposed readjusting spring for enabling a continued drive movement along a defined path after stopping of the operating lever in order that the blow-out procedure is carried out.

23. A dosing device according to claim 20, wherein the drive element interacts with the pressure container via a pressure lever.

24. A dosing device according to claim 19, wherein the blow-out line comprises a check valve at an opening the blow-out line into the discharge device, and wherein said check valve acts simultaneously with a pressure valve connected to a pressure container.

25. A dosing device according to claim 1, wherein the discharge line comprises a check valve at an opening of the discharge line into the discharge device.

26. A dosing device according to claim 1, wherein the device is adapted for dispensing of a liquid having one or more different components that are comprised of a temporarily stable peroxide-alcohol mixture.

* * * * *